US008346152B2

(12) United States Patent
Matsushima

(10) Patent No.: US 8,346,152 B2
(45) Date of Patent: Jan. 1, 2013

(54) AUTOMATIC DOCUMENT FEEDER AND IMAGE READING DEVICE

(75) Inventor: Ryoichi Matsushima, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 491 days.

(21) Appl. No.: 12/408,349

(22) Filed: Mar. 20, 2009

(65) Prior Publication Data

US 2009/0245905 A1 Oct. 1, 2009

(30) Foreign Application Priority Data

Mar. 25, 2008 (JP) ..... 2008-078621

(51) Int. Cl.
*G03G 15/00* (2006.01)
*B65H 31/08* (2006.01)
*B65H 31/04* (2006.01)

(52) U.S. Cl. ..... 399/367; 271/212; 271/213; 399/405

(58) Field of Classification Search ..... 399/367, 399/403, 404, 405
See application file for complete search history.

(56) References Cited

U.S. PATENT DOCUMENTS 4,699,371 A * 10/1987 Ettischer et al. ..... 271/99
5,649,697 A * 7/1997 Kurishita et al. ..... 271/97
6,095,517 A * 8/2000 Dinatale ..... 271/212
6,341,934 B1 * 1/2002 Takeno et al. ..... 414/791.2
7,532,850 B2 * 5/2009 Won ..... 399/365
7,762,543 B2 * 7/2010 Matsushima ..... 271/3.14
2002/0005610 A1 * 1/2002 Moore et al. ..... 271/11
2002/0074711 A1 * 6/2002 Higaki ..... 271/117
2003/0062669 A1 * 4/2003 Yamakawa et al. ..... 271/176
2007/0210512 A1 * 9/2007 Sakakibara et al. ..... 271/314
2008/0217847 A1 * 9/2008 Suzuki ..... 271/277

FOREIGN PATENT DOCUMENTS

JP 2001-106408 4/2001
JP 2007-238252 9/2007

* cited by examiner

*Primary Examiner* — Daniel J Colilla
*Assistant Examiner* — Allister Primo
(74) *Attorney, Agent, or Firm* — Banner & Witcoff, Ltd.

(57) ABSTRACT

There is provided an automatic document feeder, comprising: a document tray; an output tray; a movable ejection flap configured to be movable between a first position where the document for which the image reading is finished is sunk into a position between the output tray and a bottom of a stacked document already staked on the output tray and a second position where the document is ejected on the output tray without being sunk into the position; a setting unit configured to set the movable flap to one of the first position and the second position; a change unit configured to change a position of the movable flap to the second position in response to a fact that a predetermined condition is satisfied in a state where the position of the movable flap has been set to the first position through the setting unit.

9 Claims, 9 Drawing Sheets

AUTOMATIC DOCUMENT FEEDER AND IMAGE READING DEVICE

CROSS-REFERENCE TO RELATED APPLICATION

This application claims priority under 35 U.S.C. §119 from Japanese Patent Application No. 2008-078621, filed on Mar. 25, 2008. The entire subject matter of the application is incorporated herein by reference.

BACKGROUND

1. Technical Field

Aspects of the present invention relate to an automatic document feeder and an image reading device.

2. Related Art

Automatic document feeders are widely used for image reading devices. In Japanese Patent Provisional Publication No. 2007-238252A (hereafter, referred to as JP 2007-238252A), an example of an automatic document feeder is disclosed. The automatic document feeder disclosed in JP 2007-238252A is configured to eject a document for which the image reading is finished is stacked on an output tray so as to be sunk into a bottom of stacked documents already staked on the output tray so that the documents are placed on the output tray in ascending order. More specifically, the automatic document feeder disclosed in JP 2007-238252A is provided with a spring member to lift the rear edge portion of the documents so that sinking ejection can be achieved.

SUMMARY

Incidentally, in the sinking ejection, a document for which the image reading is completed is sunk into a position between the output tray and a bottom of the staked documents already staked on the output tray. Therefore, if the total weight of the documents on the document tray is relatively large or the document being carried has a curl, it becomes difficult to sink the document into the position between the output tray and a bottom of the stacked documents on the output tray.

However, since in the sinking ejection the documents are ejected on the output tray in order in which the documents are arranged on the document tray, the user may want to execute the sinking operation. Therefore, the sinking ejection is convenient for the user. It is not preferable to disable the sinking ejection mode.

Aspects of the present invention are advantageous in that an automatic document feeder capable of executing the sinking ejection while keeping user convenience.

According to an aspect of the invention, there is provided an automatic document feeder, comprising: a document tray on which a document to be read is placed; an output tray on which the document for which image reading is finished is placed; a movable ejection flap configured to be movable between a first position where the document for which the image reading is finished is sunk into a position between the output tray and a bottom of a stacked document already staked on the output tray and a second position where the document is ejected on the output tray without being sunk into the position between the output tray and the bottom of the stacked document; a setting unit configured to set the movable flap to one of the first position and the second position; a change unit configured to change a position of the movable flap to the second position in response to a fact that a predetermined condition is satisfied in a state where the position of the movable flap has been set to the first position through the setting unit.

With this configuration, it becomes possible to change the position of the ejection flap to the second position if the predetermined condition is satisfied. Therefore, it becomes possible to prevent failure of the sinking ejection from occurring without disabling the sinking ejection function of the automatic document feeder. Therefore, user convenience can be enhanced.

According to another aspect of the invention, there is provided an image reading device, comprising the above described automatic document feeder; and a reading portion configured to read a document carried to the reading portion.

With this configuration, it becomes possible to change the position of the ejection flap to the second position if the predetermined condition is satisfied. Therefore, it becomes possible to prevent failure of the sinking ejection from occurring without disabling the sinking ejection function of the automatic document feeder. Therefore, user convenience can be enhanced.

It is noted that various connections are set forth between elements in the following description. It is noted that these connections in general and unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

BRIEF DESCRIPTION OF THE ACCOMPANYING DRAWINGS

DETAILED DESCRIPTION

Hereafter, an embodiment according to the invention will be described with reference to the accompanying drawings.

Figure 1:
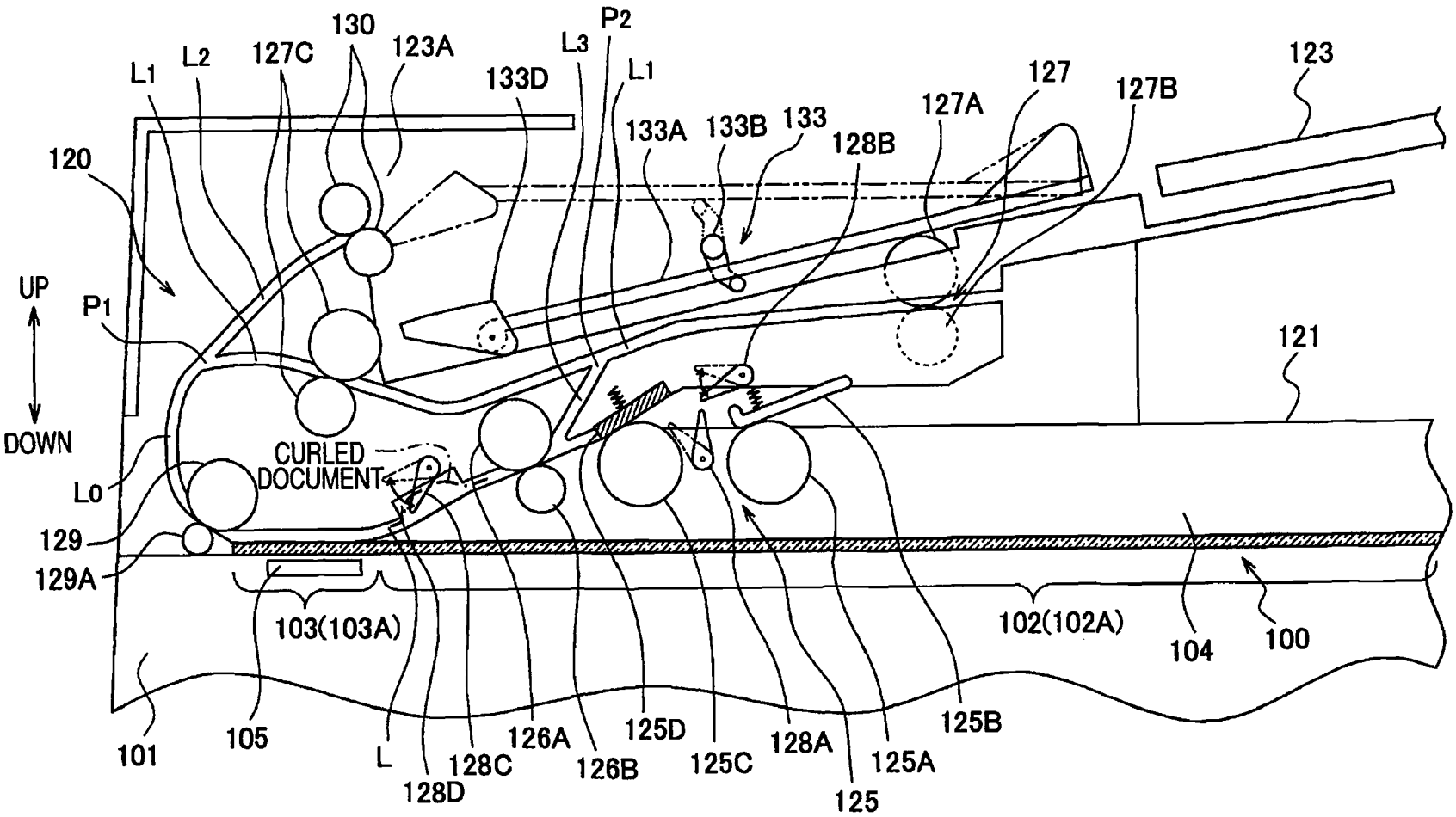
FIG. 1 is a cross-sectional view of an automatic document feeder.
Figure 2:
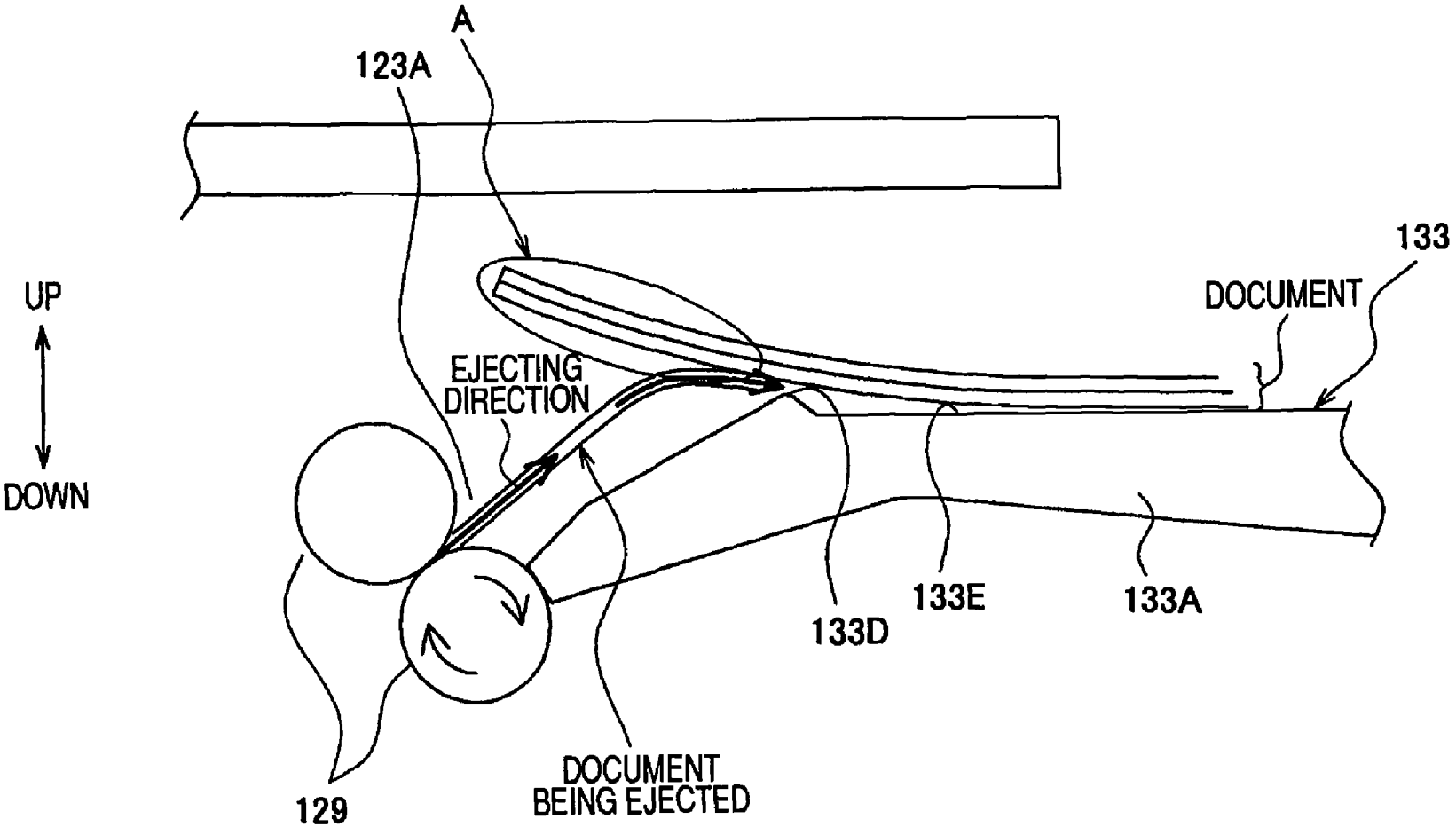
FIG. 2 is an explanatory illustration for explaining an operation of a sinking mechanism.
Figure 3:
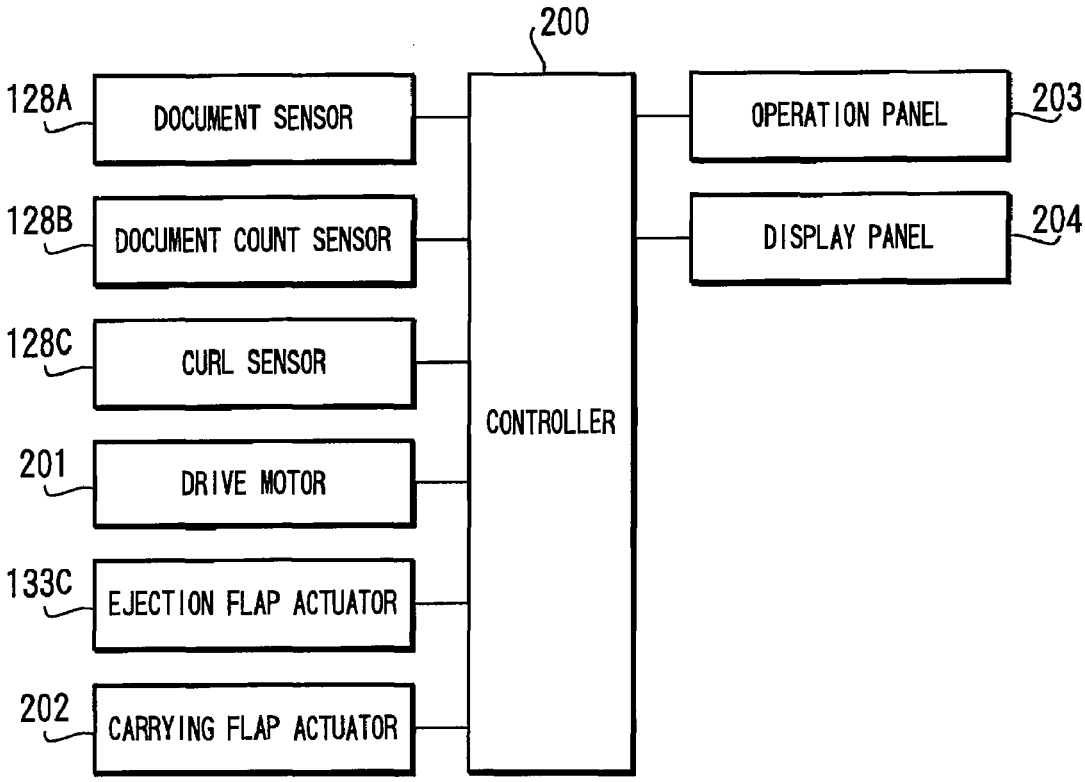
FIG. 3 is a block diagram of a control system of an image reading device.
Figure 4:
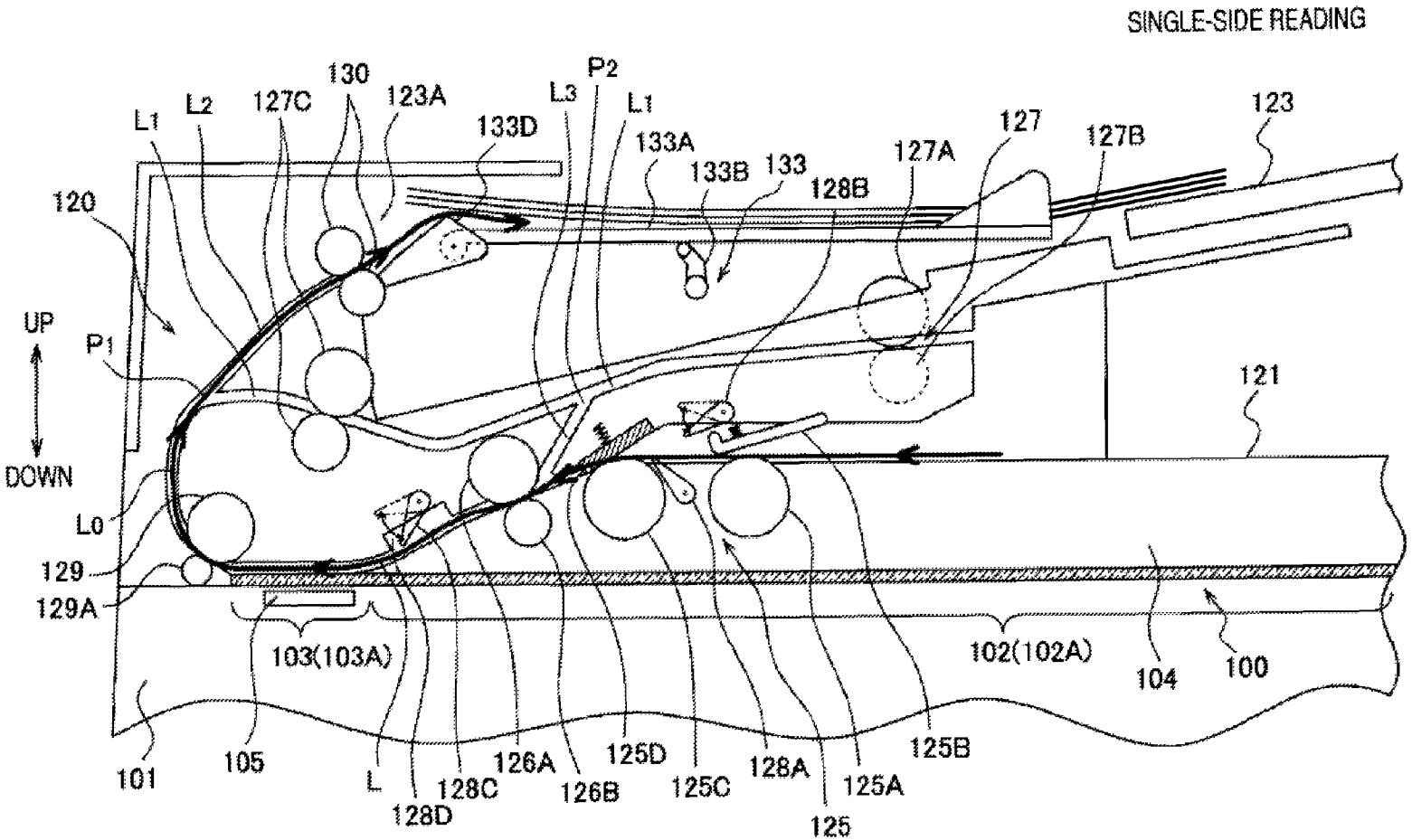
FIGS. 4-6 are explanatory illustrations for explaining carrying operations.
Figure 5:
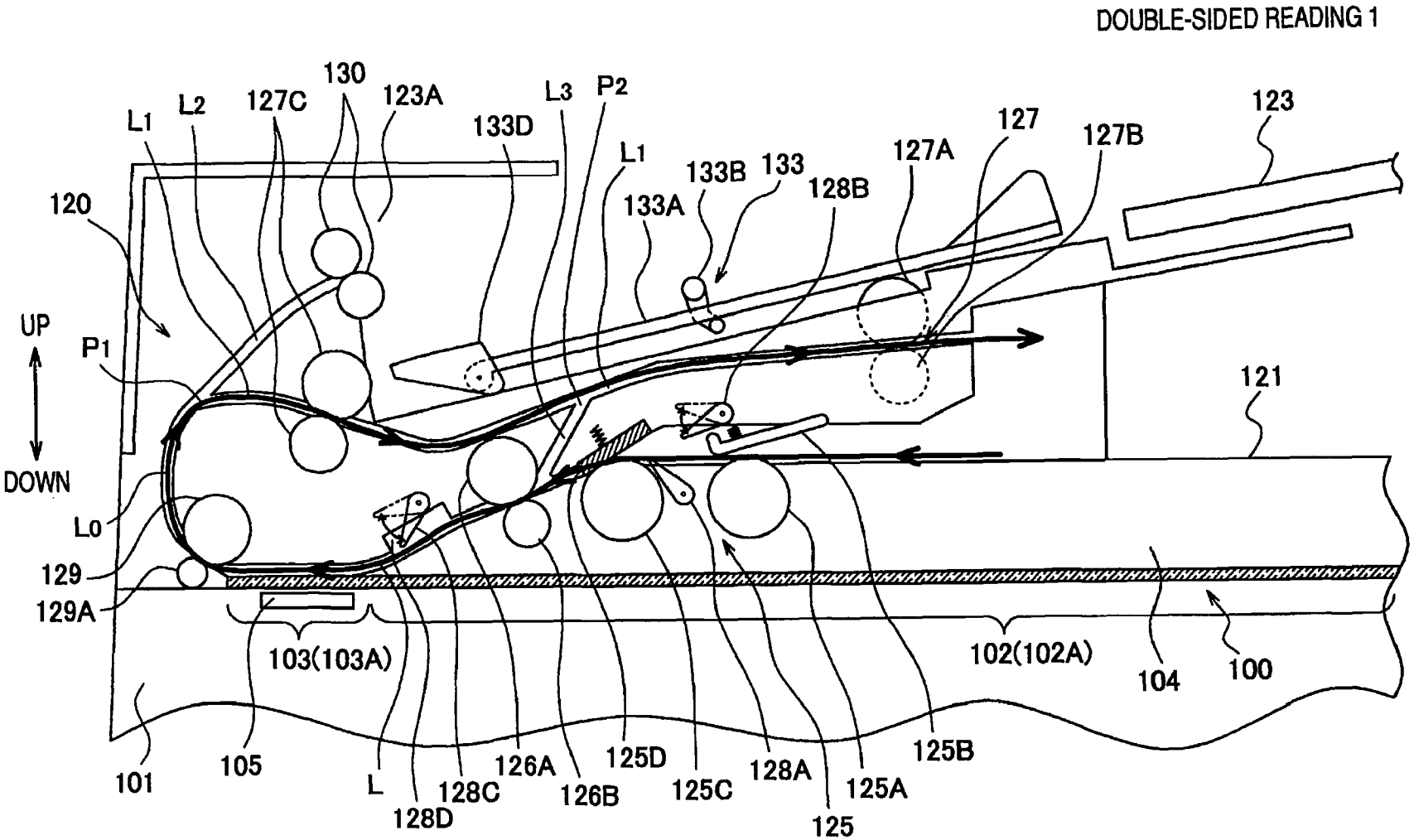
Figure 6:
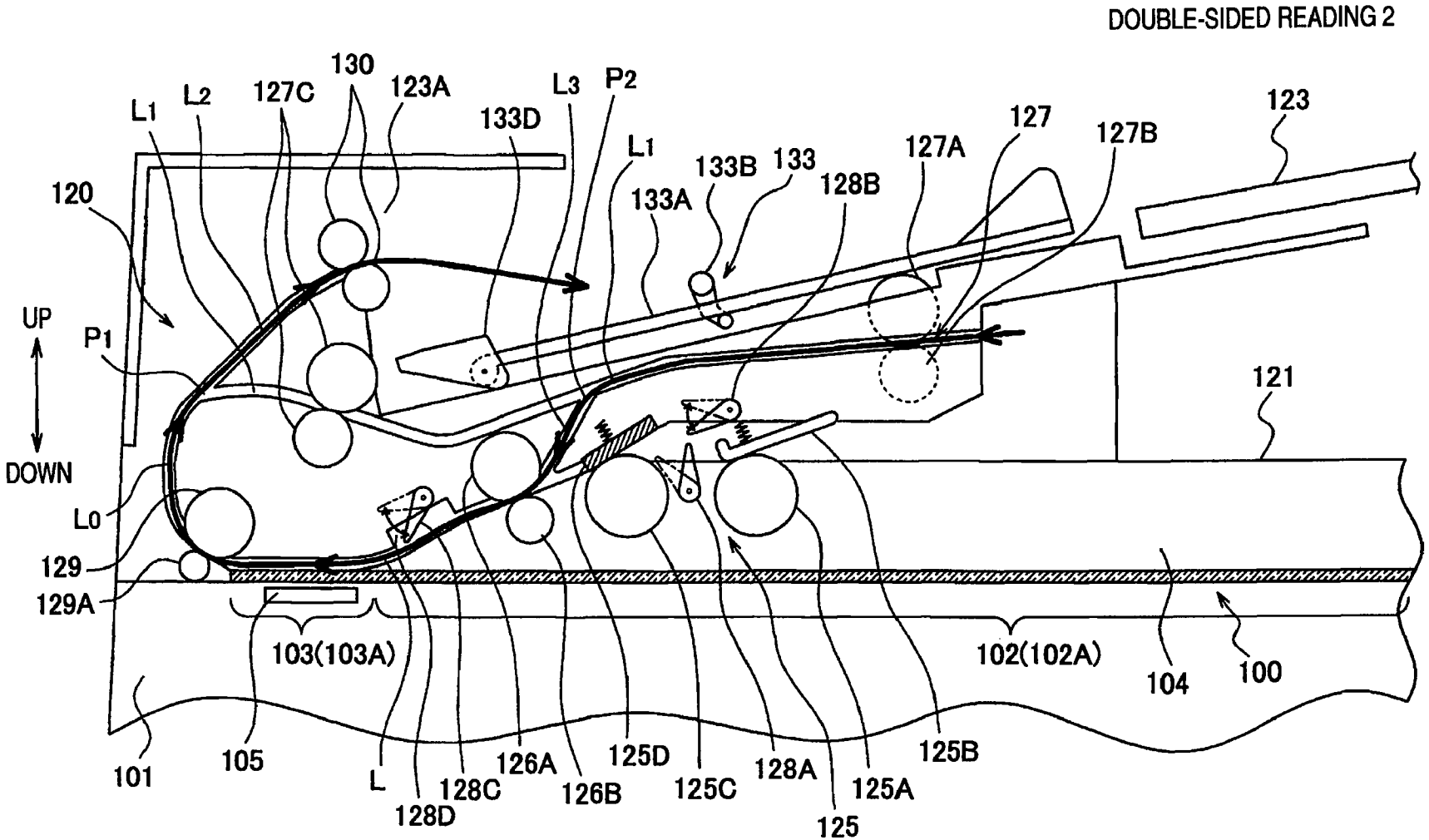

FIG. 1 is a cross sectional view of an ADF (Automatic Document Feeder) 120 provided in an image reading device 100. FIG. 2 is an explanatory illustration for illustrating an operation of a sinking mechanism 133. FIG. 3 is a block diagram of a control system of the ADF 120. FIGS. 4-6 are explanatory illustrations for explaining carrying states in the ADF 120.

Figure 7:
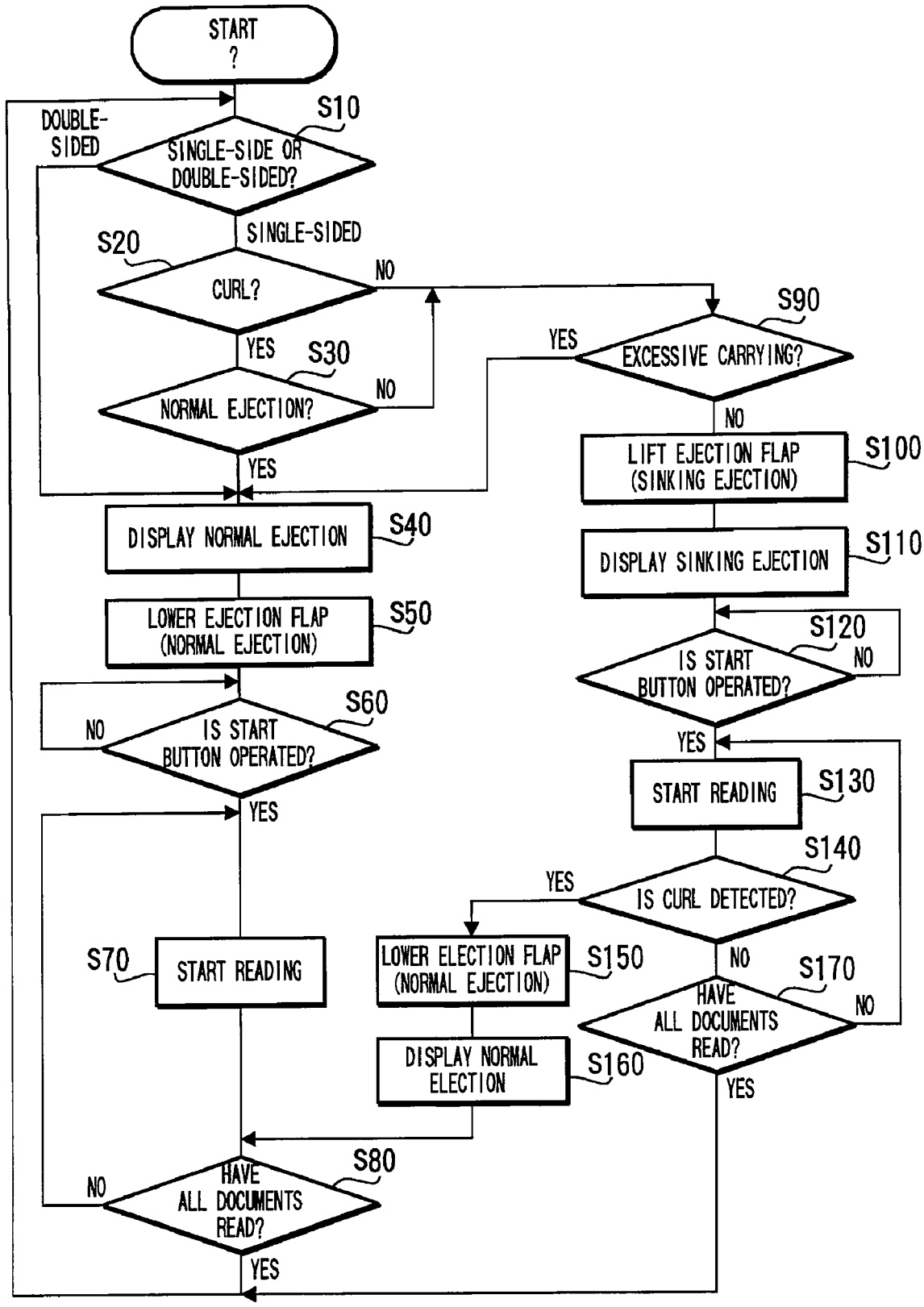
FIG. 7 is a flowchart illustrating a carrying control operation of an automatic document feeder.

FIG. 7 is a flowchart illustrating a carrying control process executed in the ADF 120. FIGS. 8-11 illustrate examples of screens displayed on a display panel 204 of the ADF 120.

As shown in FIG. 1, the image reading device 100 is provided with an image read window 102 (hereafter, referred to as a still read window 102) used for a still document reading function, and an image read window 103 (hereafter, referred to as an automatic read window 103) used for an automatic carrying and reading function. The still read window 102 and the automatic read window 103 are respectively sealed with transparent platens 102A and 103A made of glass or acrylic.

In this embodiment, the platens 102A and 103A are formed of a glass plate. That is, the two types of platens 102A and 103A are integrally formed of a glass plate. A document cover 104 for covering the windows 102 and 103 is pivotally provided on the upper side of a main body 101. Therefore, when the document reading is performed through the still reading window 102, a user opens the document cover 104 upward, and places a document on the still reading window 102.

In the main body 101, an image pick-up device 105 configured to emit light to illuminate the document and to generate an electric signal in accordance with the received light is provided. The image reading device 100 executes the reading operation by converting the image formed on the document into an electric signal through the image pick-up device 105.

In this embodiment, the image pick-up device 105 is formed of a CIS (Contact Image Sensor) configured to be elongated in a direction perpendicular to the moving direction thereof beneath the reading windows 102 and 103.

The image pick-up device 105 is mounted in the main body 101 to be movable along a longitudinal direction of the image reading device 100 (i.e., a left and right direction on FIG. 1). During execution of the automatic feed/read function, the image pick-up device 105 reads the image from the document while being fixed at the position beneath the automatic read window 103. On the other hand, when the still document read function is executed, the image pick-up device 105 reads the image from the document while being moved under the still read window 102.

At a portion of the document cover near the automatic read window 103, the ADF 120 configured to feed the document to the automatic read window 103 is provided.

The ADF 120 includes a document tray 121 on which a document to be read is placed. On the upper side of the document tray 121, an output tray 123 on which the document for which the image reading is completed is placed is provided. Regarding the document having a plurality of sheets of paper, such document is placed on the document tray or the output tray in a state where the plurality of sheets of paper are stacked in a vertical direction.

On the side of the document tray 121 nearer to the automatic read window 103, a feeder mechanism 125 is provided. The feeder mechanism 125 is configured to feed a plurality of documents placed on the document tray 121 one by one to the automatic read window 103 from the bottom of the stacked documents. More specifically, the feeder mechanism 125 includes a pick-up roller 125A, a nip piece 125B, a separation roller 125C and a separation pad 125D.

The pick-up roller 125A rotates and contacts the under surface of the document at the bottom of the document tray to carry the document to the side of the separation roller 125C. The nip piece 125B serves to press the document against the pick-up roller 125A.

Further, the separation roller 125C applies a carrying force to the document by rotating and contacting the under surface of the document as in the case of the separation roller 125A. The separation pad 125D contacts the document on the opposite side of the separation roller 125C with respect to the document to apply carrying resistance to the document.

Therefore, only the document contacting the separation roller 125C is carried from the separation roller 125C, and other documents situated on the side of the separation pad 125D with respect to the document contacting the separation pad 125D are stopped by the carrying resistance from the separation pad 125D. Consequently, the documents placed on the document tray 121 are carried to the automatic read window 103 one by one from the bottom of the stacked documents.

A carrying roller 126A carries the document from the separation roller 125C to the automatic read window 103 by rotating and contacting the document at the lower surface thereof. A pinch roller 126B is a presser roller pressing the document against the first carrying roller 126A. The pinch roller 126B is a driven roller driven by the document being carried.

A document sensor 128A is located on the upstream side of the separation roller 125C. The document sensor 128A detects whether the document is placed on the document tray 121. A document count sensor 128B detects a total weight of the documents stacked on the document tray 121 by detecting the number of documents (i.e., height) stacked on the document tray 121.

When the document is placed on the document tray 121, the document sensor 128A moves to a state indicated by a double chain line in FIG. 1 by the weight of the documents, and outputs an ON signal. On the other hand, when no document is placed on the document tray 121, the document sensor 128A moves to a state indicated by a solid line in FIG. 1, and outputs an OFF signal.

When the height of the documents placed on the document tray 121 is lower than or equal to a predetermined height, the document count sensor 128A is in a state indicated by a solid line in FIG. 1, and outputs an OFF signal. On the other hand, when the height of the documents placed on the document tray 121 is higher than the predetermined height, the document count sensor 128A moves to a state indicated by a double chain line in FIG. 1, and outputs an ON signal.

A curl sensor 128C detects whether a curl is produced on the document carried from the document tray 121. If the document has a curl, a curled part of the document fits into a recessed part 128D, the curl sensor 128C moves to a state indicated by a double chain line in FIG. 1, and the curl sensor 128C outputs a On signal. If no curl is produced on the document, the curl sensor 128C moves to a state indicated by a solid line in FIG. 1, and the curl sensor 128C outputs an OFF signal.

The recessed part 128D is formed to be recessed from the inner surface of the document carrying path L toward the outside (i.e., recessed in a direction perpendicular to the carrying direction.

At a position shifted to the downstream side from the platen 103A, a carrying roller 129A for carrying the document which has passed the automatic read window 103 to the output tray 123 is provided. The document to which the carrying force is applied by the carrying roller 129A is turned upward by 180 degrees by a document guiding part (not shown) and then is ejected to the output tray 123.

A pinch roller 129 serves as a presser roller which presses the document against the carrying roller 129A. The pinch roller 129 is a driven roller which contacts the document and is driven by the document being carried.

A carrying path L0 on the downstream side of the carrying roller 129A branches at a branch point P1 into a carrying path L1 on the lower side and a carrying path L2 on the upper side. The carrying path L1 connects to the reversing mechanism 127.

The reversing mechanism 127 is configured to reverse the carrying direction of the document which has passed the automatic read window 103 to carry again the document to the automatic read window 103. Specifically, the reversing mechanism 127 includes a switch-back roller 127A and a pinch roller 127B which presses the document against the switch back roller 127A.

When the rear edge of the document carried to the reversing mechanism 127 passes a branch point P2, the switch-back roller 127A rotates inversely to carry the document to a carrying path L3.

Carrying rollers 127C serve to carry the document carried to the carrying path L1 to the reversing mechanism 127. For each of the branch points P1 and P2, a carrying flap for switching carrying paths is provided.

The carrying path L2 which is formed by branching upward at the branch point P1 connects to an ejection opening 123A for ejecting the document for which the image reading is finished, to the output tray 123. At the portion of the ejection opening 123A, a pair of ejection rollers 130 are provided.

On the side of the ejection opening 123A on the output tray 123, a sinking mechanism 133 for sinking the document into the position between the documents already stacked on the output tray 123 and the output tray 123. Hereafter, such a sinking operation is referred to as sinking ejection.

The sinking mechanism 133 includes an ejection flap 133A for executing the sinking ejection, a crank 133B for swinging the ejection flap 133A between a first position (indicated by a double chain in FIG. 1) and a second position (indicated by a solid line in FIG. 1), and an actuator 133C (see FIG. 3) which rotates a crank 133B.

At an edge of the ejection flap 133A, a projected part 133D for lifting the document on the output tray 123 on the side of the ejection opening 123A is provided.

When the ejection flap 133A is situated at the first position, the part of the document on the side of the ejection opening 123A with respect to the projected part 133D is lifted upward from the output tray 123. In this case, the document newly ejected from the ejection opening 123A contacts the part A at which the document is lifted (see FIG. 2).

Therefore, the document newly ejected from the ejection opening 123A contacts the under surface of the document in an acute angle at the bottom of the stacked documents on the output tray 123, and the document turns toward a flat part 133E to which the projected part 133D connects. Consequently, the document ejected from the ejection opening 123A sinks into the position between the bottom of the stacked documents on the output tray 123 and the surface of the output tray 123.

When the ejection flap 133A is situated at the second position, the document ejected from the ejection opening 123A is stacked on the documents already stacked on the output tray 123 (i.e., stacked on the top of the stacked documents) without being subjected to the sinking ejection. Hereafter, an ejection operation performed when the ejection flap 133A is situated at the second position is referred to as normal ejection.

Hereafter, the control system of the ADF 120 is explained with reference to FIG. 3. As shown in FIG. 3, the output signals from the document count sensor 218B and the curl sensor 128C are input to a controller 200. The controller 200 controls a drive motor 201 for driving various motors, an actuator 202 for activating the carrying flap, and an actuator for swinging the ejection flap 133A.

The controller 200 is, for example, a microcomputer chip in which a CPU, a ROM and a RAM are embedded. The program for executing a process shown in FIG. 7 is stored on the ROM. The CPU executes control processes by reading the programs from the ROM.

On the upper front portion of the image reading device 100, a display panel 204 for operating and setting the image reading device 100 is provided. The controller 200 also controls the display panel 204.

Figure 8:
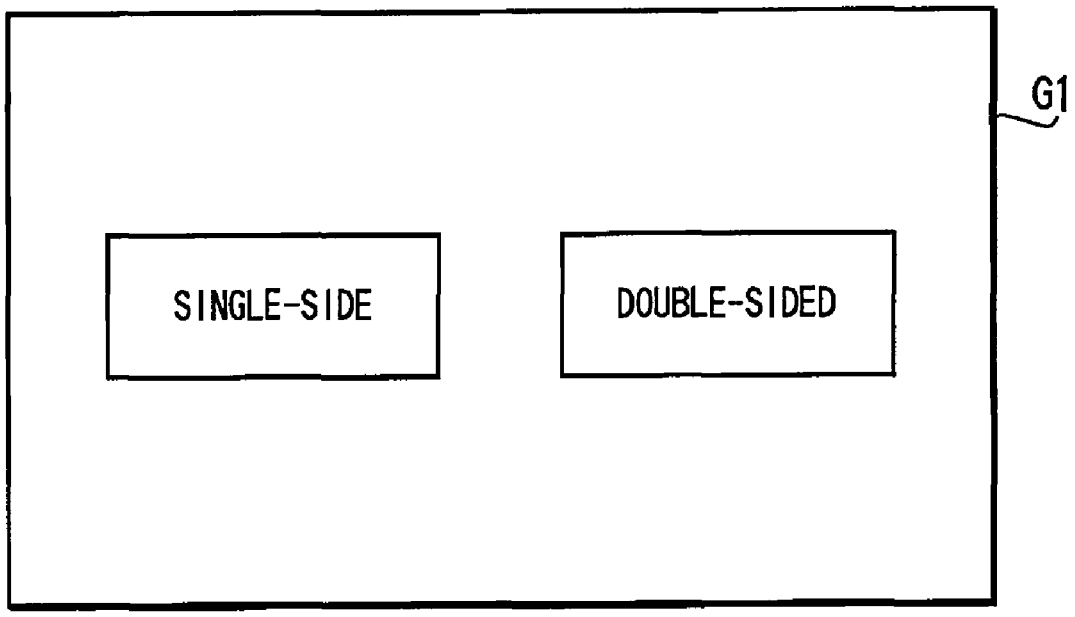
FIGS. 8-11 are examples of onscreen representation displayed on a display panel during activation of the automatic document feeder.
Figure 9:
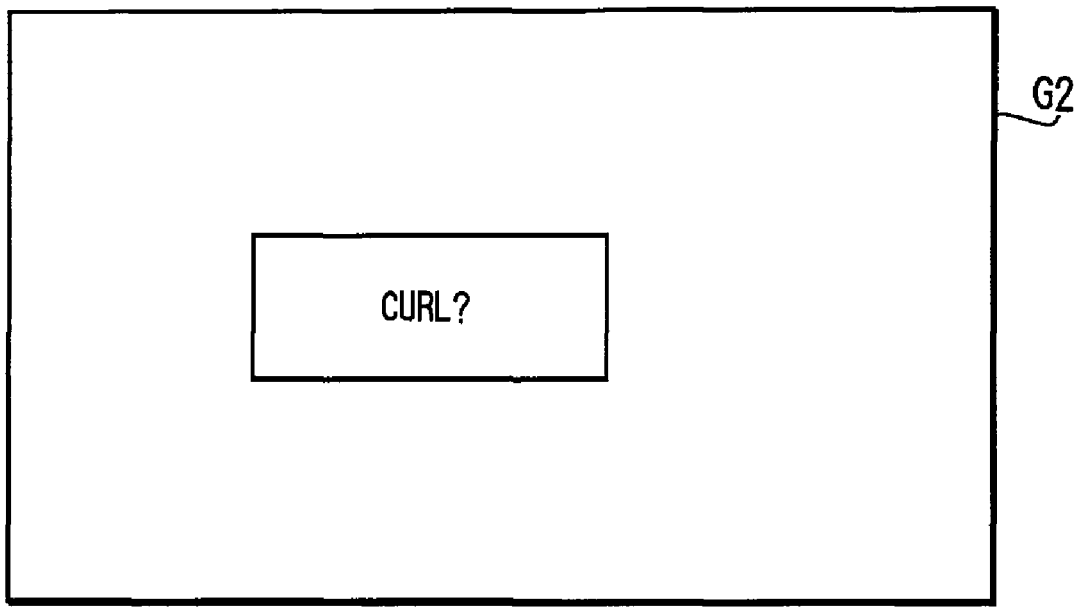
Figure 10:
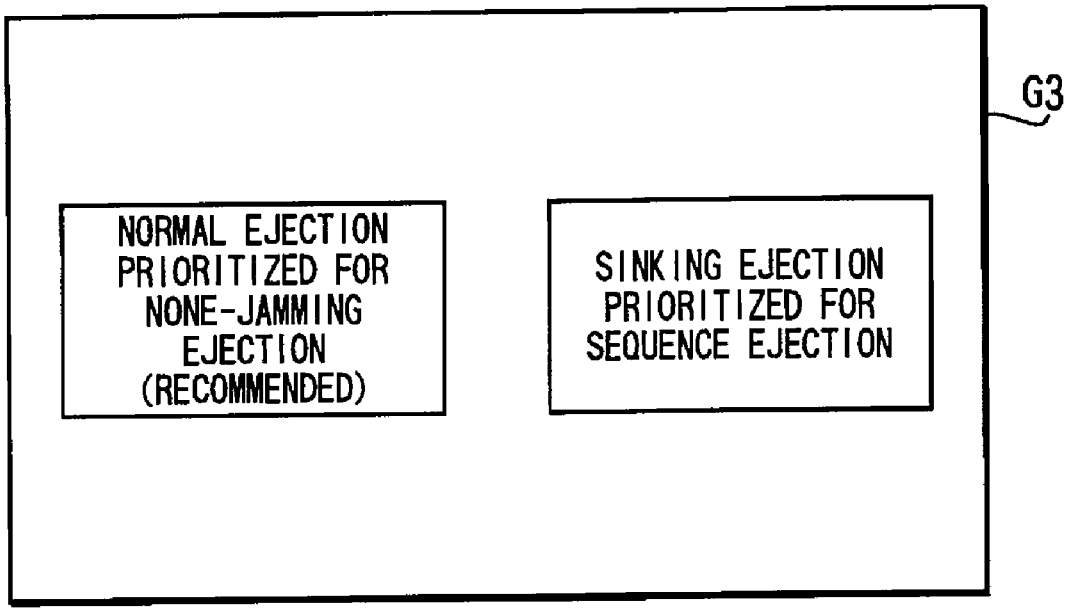
Figure 11:
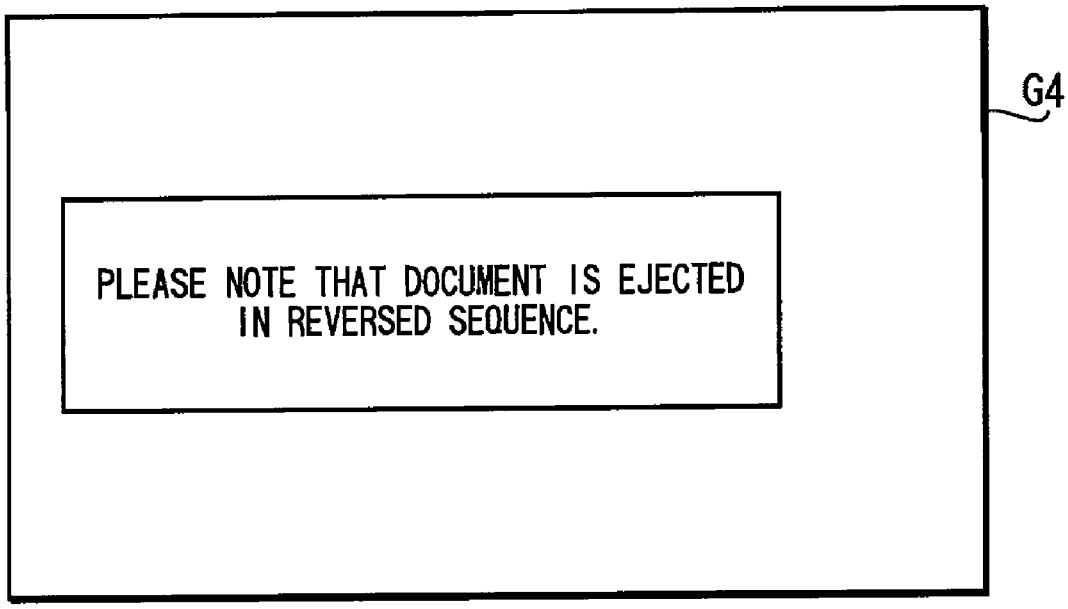

Hereafter, the carrying control operation is explained. As described in detail below, the ADF 120 is configured to be able to execute the single-side reading and the double-sided reading. On the display panel 204, a read mode selection screen G1 is displayed as shown in FIG. 8. Therefore, the user is able to select one of the reading modes through the screen shown in FIG. 8. In the following, a general operation of the ADF 120 is explained first.

Hereafter, the single-side reading is explained.

When the user selects the single-side reading mode through the operation panel 203, the document is carried as indicated by a thick arrow in FIG. 4, the ejection flap 133A is set to the first position as initial setting to execute the sinking ejection.

The expression "the ejection flap 133A is set to the first position as initial setting" includes a state where the ejection flap 133A is actually moved to the first position and a state where the setting value for setting the ejection flap 133A to the first position is set. In this embodiment, the initial setting in the single-side reading mode is set to the first position as factory setting.

More specifically, when a read start button (not shown) is pressed by the user in a state where a plurality of documents are placed on the document tray 121 such that a reading surface of each document faces downward, the drive motor 201 starts to rotate, and the documents stacked on the document tray 121 are fed to the automatic read window 103 one by one from the document at the bottom of the stacked document on the document tray 121 so as to start the image reading.

When the single-side reading mode is selected by the user, the controller 200 activates the actuator 202 for the carrying flap and activates the actuator 133C for the ejection flap 133A to move the ejection flap 133A to the first position so that the document which has fed from the document tray 121 and which has passed the automatic read window 103 is ejected from the ejection opening 123A through the carrying path L0 and the carrying path L2.

Therefore, the documents for which the image reading is finished are stacked on the output tray 123 one by one such that the document sinks into the position between the bottom of the staked document already stacked on the output tray 123 and the surface of the output tray 123.

Therefore, in the single-side reading mode, the documents are stacked one by one on the output tray from the bottom to the top such that the reading surface of each document faces upward. That is, in the single-side reading mode, the documents stacked on the document tray 121 are placed on the output tray 123 in a flipped state.

Hereafter, the double-sided reading mode is explained.

When the double-sided reading mode is selected by the user through the operation panel 203, the document is carried as indicated by a thick arrow shown in FIG. 5 first. Then, the carrying direction is reversed by the reversing mechanism 127, and the document is carried as indicated by a thick arrow shown in FIG. 6 so as to read the back-face of the document, and thereafter the document is ejected to the output tray 123 via the ejection opening 123A in the normal ejection.

Specifically, when the read start button is pressed by the user in a state where the reading surface of each document faces downward and a plurality of documents are placed on the document tray 121, the drive motor 201 starts to rotate, and the documents stacked on the document tray 121 are fed to the automatic read window 103 one by one from the document at the bottom of the stacked document on the document tray 121 so as to start the image reading.

When the double-sided reading mode is selected by the user, the controller 200 activates the actuator 202 for the carrying flap so that the document which has passed the automatic read window 103 is carried to the reversing mechanism 217 via the carrying path L1, and activates the actuator 133C to move the ejection flap 133A to the second position.

Therefore, the document for which the image reading is finished is carried along the carrying path L1 to the reversing mechanism 127 as indicated by a thick arrow shown in FIG. 5. When the rear edge of the document passes the branching point P2, the controller 200 activates the actuator 202 for the carrying flap and inverses the rotational direction of the reversing mechanism 127 so that the document of which carrying direction is reversed is carried to the carrying path L3.

Therefore, as shown in FIG. 6, the document of which front-face has been read is carried again to the automatic read window 103 to read the back-face of the document. Then, the document for which the image reading is finished is ejected to the output tray 123 via the ejection opening 123A.

At this time, the document being ejected to the output tray 123 is stacked on the documents already stacked on the output tray 123. Therefore, in the double-sided reading mode, the documents are stacked on the output tray 123 from the bottom to the top one by one such that each front-face faces downward. That is, in the double-sided reading mode, the plurality of documents stacked on the document tray 121 are placed on the output tray 123 as it is.

FIG. 7 is a flowchart illustrating the carrying control process executed under control of the controller 200. The carrying control process is started when the image reading device is turned to ON, and is terminated when the image reading dice 100 is turned to OFF.

When the carrying control process is started, the controller 200 judges which of the single-side reading mode and the double-sided reading mode is selected (step S10). When the single-side reading mode is selected (S10: single-side), the controller 200 judges whether a curl is produced on the document in accordance with a user operation on the operation panel 203 (step S20).

More specifically, in step S20, the controller 200 displays a screen for inquiring of the user whether a curl is produced on the document on the display panel 204. The controller judges whether a curl is produced on the document in accordance with a response (i.e., a user operation) from the user.

If it is judged that a curl is produced on the document in step S20 (S20: YES), the controller 200 judges whether to execute the normal ejection (step S30).

As described above, although in the single-side reading mode the document is ejected on the sinking ejection, it is difficult to sink the document into the bottom of the staked documents already stacked on the output tray 123 if a curl is produced on the document. Therefore, in this case, the ADF 120 may fail in the sinking ejection.

Therefore, in step S30, the controller 200 displays a screen for displaying a warning message indicating that the sinking ejection might be unsuccessful and for inquiring of the user whether to continue the sinking ejection or to change to the normal ejection, on the display panel 204. Further, the controller 200 judges whether to execute the normal ejection in accordance with the user response.

If it is judged in step S30 that the ejection mode is the normal ejection (S30: YES) or if it is judged that the double-sided reading mode is selected (S10: double-sided), the controller 200 displays, on the display panel 204, a warning message indicating that the page sequence of the documents on the output tray 123 will become different from the page sequence of the documents on the document tray 121 (see a screen G$ shown in FIG. 11) (step S40). Then, the controller 200 moves the ejection flap 133A to the second position (step S50).

Next, the controller 200 judges whether the read start button on the operation panel 203 is pressed by the user (step S60). The controller 200 waits until the read start button is pressed (S60: NO). If the read start button is pressed (S60: YES), the controller 200 starts to rotate the drive motor 201, and the image reading is started (step S70).

When the image reading for the first sheet of paper is finished (S70), the controller 200 judges whether all the documents have been read in accordance with the output signal from the document sensor 128A (step S80). If all the documents have not been read (S80: NO), control returns to step S70 to continue the image reading. If all the documents have been read (S80: YES), control returns to step S10.

If it is judged in step S20 that the document has no curl (S20; NO) or if the sinking ejection mode is designated (S30: NO), the controller 200 judges whether the number of documents placed on the document tray 121 is larger than or equal to a predetermined number of sheets in accordance with the output signal from the document count sensor 128B (step S90). That is, the controller judges whether the total weight of the documents on the document tray 1211*a* larger than or equal to a predetermined value.

If it is judged that the number of documents on the document tray 121 is larger than or equal to the predetermined number of sheets (S90: YES), control proceeds to step S40. On the other hand, if the number of documents on the document tray 121 is smaller than the predetermined number of sheets (S90: NO), the controller 200 moves the ejection flap 133A to the first position (step S100). Then, the controller 200 displays, on the display panel 204, a message indicating that the sinking ejection is executed (step S110).

Next, the controller 200 judges whether the read start button on the operation panel 203 is pressed by the user (step S120). The controller 200 waits until the read start button is pressed (S120: NO). If the read start button is pressed (S120: YES), the controller 200 starts to rotate the drive motor 201, and the image reading is started (step S130).

Next, the controller 200 judges whether a curl is produced on the document (step S140). If a curl is produced on the document (S140: YES), the controller 200 moves the ejection flap 133A to the second position (step S150). Then, the controller 200 displays, on the display panel 140, the warning message (see a screen G4 in FIG. 11) (step S160). Then, control proceeds to step S80.

If no curl is produced on the document (S140: NO), the controller 200 judges whether all the documents have been read in accordance with the output signal from the document sensor 128A (step S170). If all the documents have not been read (S117: NO), control returns to step S130 to continue the image reading. If all the documents have been read (S170: YES), control returns to step S10.

As described above, the image reading device 100 changes the position of the ejection flap 133A to the second position in response to a fact that a predetermined condition is satisfied. The predetermined condition includes a condition where the number of documents on the document tray 121 is larger than or equal to a predetermined value or a condition where a curl is produced on the document.

That is, if the sinking ejection is performed in a state where the number of documents on the document tray is large, a possibility that paper jam will occur in the output tray increases. Therefore, it might be preferable that the sinking ejection is avoided to prevent occurrence of paper jam even if the page sequence is changed on the output tray. For this reason, in this embodiment, the controller prohibits the sinking ejection if the possibility that the paper jam will occur is high so as to avoid occurrence of paper jam.

In the embodiment, when the controller receives the command for moving the ejection flap 133A to the second position from the user, the controller moves the ejection flap 133A to the second position. Such a configuration makes it possible to prevent occurrence of paper jam while properly reflecting the user's intention.

In this embodiment, the controller judges that the predetermined condition is satisfied when the number of documents on the document tray becomes larger than or equal to the predetermined number of sheets (i.e., when the total weight of the documents on the placed on the document tray becomes larger than or equal to the predetermined value). Further, when the controller judges that the predetermined condition is satisfied, the controller moves the ejection flap 133A to the second position. Such a configuration makes it possible to change the position of the ejection flap 133A to the second position if the possibility that paper jam will occur is high. Consequently, occurrence of paper jam can be avoided.

It should be noted that the predetermined number of sheets and the predetermined value of the total weight respectively correspond to the number of documents and the total weight of documents leading to the high possibility of occurrence of paper jam. Such a predetermined number of sheets and the predetermined value of the total weight vary depending on the type of paper. Therefore, the predetermined number of sheets and the predetermined value of the total weight may be determined in advance depending the result of experiment.

In this embodiment, the controller judges that the predetermine condition is satisfied when it is judged that a curl is produced on the document, and in this case the controller moves the ejection flap 133A to the second position. Therefore, the position of the ejection flap 133A can be changed to the second position when the possibility that paper jam will occur is high. Therefore, occurrence of paper jam can be avoided.

Although the present invention has been described in considerable detail with reference to certain preferred embodiments thereof, other embodiments are possible.

In the above described embodiment, the controller judges that the predetermined condition is satisfied when a curl is produced on the document or when the number of documents on the document tray is larger than or equal to the predetermined number of sheets. However, the predetermined condition is not limited to such examples.

Various types of conditions which are detected on the document tray or along the carrying path may be used to change the position of the ejection flap 133A to the second position. For example, the controller may judge that the predetermined condition is satisfied if the type of document is a predetermined type.

In the above described embodiment, the controller decides to perform sinking ejection when the single-side reading mode where activation of the reversing mechanism 127 is not required is selected, while the controller decides to perform the normal ejection when the double-sided reading mode where activation of the reversing mechanism 127 is required is selected. However, control of the ejection operation is not limited to such an example.

In the above described embodiment, the controller detects the total weight of documents on the document tray in accordance with the output signal from the document count sensor 128B. However, measurement of the total weight of documents is not limited to such an example.

In the above described embodiment, the controller 200 judges weather a curl is produced on the document in accordance with the output signal from the curl sensor 128C. However, detection of a curl is not limited to such an example.

For example, the number of documents or a curl produced on a document may be detected with optical means (e.g., an optical sensor).

In the above described embodiment, the ejection mode (i.e., whether to execute the normal ejection or the sinking ejection) is determined in advance based on the reading mode. However, determination of the ejection mode is not limited to such an example. For example, the ejection mode may be determined by user setting when the image reading is started.

In the above described embodiment, the technical feature is applied to the image reading device capable of executing both of the single-side reading and the double-sided reading. However, the technical feature may be applied to various types of image reading devices.

In the above described embodiment, the document tray 121 is located on a lower side of the ejection tray 123. However, the image reading device may be configured to locate the document tray on an upper side of the ejection tray. In this case, the normal ejection is used for the single-side reading mode, and the sinking ejection is used for the double-sided reading mode.

What is claimed is:

1. An automatic document feeder, comprising:

a document tray configured for placement of a document to be read thereon;

an output tray configured to hold the document to be read after image reading of the document is finished;

a movable ejection flap configured to be movable between a first position and a second position, wherein when the movable ejection flap is moved to the first position, the document for which the image reading is finished is inserted into a position between the output tray and a bottom of a stack of documents on the output tray, and wherein when the movable ejection flap is moved to the second position, the document is ejected onto the output tray in a position other than the position between the output tray and the bottom of the stack of documents, and wherein the movable ejection flap is disposed upstream from the output tray in a document ejection direction; and a change unit configured to change a position of the movable flap in response to a predetermined condition being satisfied; and a controller configured to:

determine whether the predetermined condition has been satisfied based on information received from at least one other component of the automatic document feeder, wherein the at least one other component includes a sensor; and in response to determining that the predetermined condition has been satisfied, control the change unit to change the position of the movable ejection flap from the first position to the second position when the movable ejection flap is in the first position, wherein the controller is configured to judge whether a total weight of documents placed on the document tray exceeds a predetermined value based on the information received from the at least one other component of the automatic document feeder, and wherein the predetermined condition includes the total weight of the documents placed on the document tray exceeding the predetermined value.

2. The automatic document feeder according to claim 1, wherein the controller id further configured to change the position of the movable ejection flap from the first position to the second position in response to determining a double-sided reading mode is selected.

3. The automatic document feeder according to claim 1, further comprising an accepting unit configured to accept user input, wherein the predetermined condition further includes receiving, through the accepting unit, a user command for changing the position of the movable ejection flap to the second position.

4. The automatic document feeder according to claim 1, wherein the controller is further configured to determine whether a curl is produced on the document being carried, and wherein that the predetermined condition further includes a determination that a curl is produced on the document being carried.

5. An image reading device, comprising:

a reading portion configured to read a document carried to the reading portion;

an automatic document feeder comprising:

a document tray configured for placement of a document to be read thereon;

an output tray configured to hold the document after image reading is finished;

a movable ejection flap configured to be movable between a first position and a second position, wherein when the movable ejection flap is moved to the first position, the document for which the image reading is finished is inserted into a position between the output tray and a bottom of a document stack already on the output tray, wherein when the movable ejection flap is moved to the second position, the document is ejected onto the output tray in a position other than the position between the output tray and the bottom of the document stack, and wherein the movable ejection flap is disposed upstream from the output tray in a document ejection direction; and a change unit configured to change a position of the movable ejection flap in response to a predetermined condition being satisfied; and a controller configured to:

determine whether the predetermined condition has been satisfied based on information received from at least one other component of the image reading device, wherein the at least one other component includes a sensor; and in response to determining that the predetermined condition has been satisfied, control the change unit to change the position of the movable ejection flap from the first position to the second position when the movable ejection flap is in the first position, wherein the controller is further configured to judge whether a total weight of documents placed on the document tray exceeds a predetermined value based on the information received from the at least one other component of the automatic document feeder, and wherein the predetermined condition includes the total weight of the documents placed on the document tray exceeding the predetermined value.

6. The image reading device according to claim 5, wherein the controller is further configured to change the position of the movable ejection flap from the first position to the second position in response to determining a double sided reading mode is selected.

7. The image reading device according to claim 5, further comprising an accepting unit configured to accept user input, wherein the predetermined condition includes receiving, through the accepting unit, a user command for changing the position of the movable flap to the second position.

8. The image reading device according to claim 5, wherein the controller is further configured to determine whether a curl is produced on the document being carried, and wherein the predetermined condition further includes determining that a curl is produced on the document being carried.

9. A non-transitory computer readable media storing computer readable instructions that, when executed, cause an apparatus to:

determine whether a predetermined condition has been satisfied based on information from at least one component of the apparatus, wherein determining whether the predetermined condition has been satisfied includes determining whether a total weight of documents placed on the document tray exceeds a predetermined value based on the information received from the at least one other component of the automatic document feeder, and wherein the at least one other component includes a sensor; and in response to determining that the predetermined condition has been satisfied, change a position of a movable ejection flap, located upstream from an output tray in a document ejection direction, from a first position to a second position when the movable ejection flap is in the first position, wherein when the movable ejection flap is moved to the first position, the apparatus is configured to insert a document for which image reading is finished into a position between the output tray and a bottom of a stack of documents on the output tray, and wherein when the movable ejection flap is moved to the second position, the apparatus is configured to eject the document onto the output tray in a position other than the position between the output tray and the bottom of the stack of documents.

* * * * *

UNITED STATES PATENT AND TRADEMARK OFFICE

CERTIFICATE OF CORRECTION

PATENT NO. : 8,346,152 B2
APPLICATION NO. : 12/408349
DATED : January 1, 2013
INVENTOR(S) : Ryoichi Matsushima It is certified that error appears in the above-identified patent and that said Letters Patent is hereby corrected as shown below:

In the Claims

Column 11, Claim 2, Line 5:
Delete "controller id further" and insert --controller is further--

Signed and Sealed this
Eighth Day of April, 2014

Michelle K. Lee

Michelle K. Lee
*Deputy Director of the United States Patent and Trademark Office*